US009920681B2

(12) United States Patent
Owaki

(10) Patent No.: US 9,920,681 B2
(45) Date of Patent: Mar. 20, 2018

(54) COOLING APPARATUS FOR INTERNAL COMBUSTION ENGINE

(71) Applicant: TOYOTA JIDOSHA KABUSHIKI KAISHA, Toyota-shi, Aichi-ken (JP)

(72) Inventor: Kazuyuki Owaki, Nagoya (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 24 days.

(21) Appl. No.: 15/040,245

(22) Filed: Feb. 10, 2016

(65) Prior Publication Data

US 2016/0245150 A1 Aug. 25, 2016

(30) Foreign Application Priority Data

Feb. 20, 2015 (JP) ..... 2015-031483

(51) Int. Cl.

| | |
|---|---|
| ***F01P 11/04*** | (2006.01) |
| ***F01P 3/02*** | (2006.01) |
| ***F01P 7/16*** | (2006.01) |
| ***F01P 5/12*** | (2006.01) |
| *F01P 7/14* | (2006.01) |

(52) U.S. Cl.

CPC ..... *F01P 7/165* (2013.01); *F01P 3/02* (2013.01); *F01P 5/12* (2013.01); *F01P 11/04* (2013.01); *F01P 7/16* (2013.01); *F01P 2003/027* (2013.01); *F01P 2007/143* (2013.01); *F01P 2007/146* (2013.01); *F01P 2025/32* (2013.01)

(58) Field of Classification Search

CPC ..... F01P 11/04; F01P 3/02; F01P 2007/146; B01F 5/0408; B01F 5/0682; B01F 5/0683

USPC ..... 123/306; 366/336, 340

See application file for complete search history.

(56) References Cited

U.S. PATENT DOCUMENTS 4,408,892 A * 10/1983 Combes ..... B01F 5/0611 138/42
4,841,938 A 6/1989 Weibler et al.
5,656,771 A 8/1997 Beswick et al.
(Continued)

FOREIGN PATENT DOCUMENTS

EP 0266480 A1 5/1988
EP 0301959 A1 2/1989
(Continued)

*Primary Examiner* — Stephen K Cronin
*Assistant Examiner* — Kody Kight
(74) *Attorney, Agent, or Firm* — Oliff PLC

(57) ABSTRACT

A cooling apparatus for an engine includes a main circuit, a warm-up circuit, a coolant passage, a coolant pump, a pre-branching passage, a coolant temperature sensor and an agitator. The warm-up circuit allows a coolant to bypass the main circuit. The coolant passage is provided inside an engine body. The coolant pump is configured to cause the coolant to flow through the coolant passage. The pre-branching passage is communicated with an outlet side of the coolant passage, and communicated with the main circuit and the warm-up circuit. The coolant temperature sensor is configured to detect a coolant temperature inside the pre-branching passage. The agitator is disposed downstream of the coolant temperature sensor in a direction of coolant flow when the coolant pump is operating. The agitator is disposed at a boundary between the pre-branching passage and the main circuit or in a vicinity of the boundary.

4 Claims, 5 Drawing Sheets

(56) References Cited

U.S. PATENT DOCUMENTS 6,497,202 B2 * 12/2002 Buysse ..... F01P 3/20 123/41.01
6,688,262 B2 * 2/2004 Murakami ..... F01P 3/20 123/41.1
7,484,502 B1 * 2/2009 Yoon ..... F01P 11/04 123/568.12
8,322,157 B2 * 12/2012 Petersen ..... B01D 19/0042 123/41.44
8,464,669 B2 * 6/2013 Honzen ..... F01P 3/02 123/41.01
8,567,357 B2 * 10/2013 Honzen ..... F01P 3/02 123/41.08
8,746,187 B2 * 6/2014 Nogawa ..... F01P 3/02 123/41.82 R
8,807,095 B2 * 8/2014 Takahashi ..... F01P 3/02 123/41.02
9,222,399 B2 * 12/2015 Quix ..... F01P 3/02
9,243,545 B2 * 1/2016 Quix ..... F01P 7/14
9,297,292 B2 * 3/2016 Takeuchi ..... F01P 3/02
9,341,103 B2 * 5/2016 D'Epiro ..... F01P 7/165
9,458,759 B2 * 10/2016 Rollinger ..... F01P 11/18
9,500,115 B2 * 11/2016 Quix ..... F01P 5/10
9,541,335 B2 * 1/2017 Kowada ..... F01P 3/20
9,562,492 B2 * 2/2017 Nomura ..... F01P 3/02
9,581,072 B2 * 2/2017 Hutchins ..... F01P 7/165
2002/0064087 A1 * 5/2002 Catalfamo ..... B01F 5/061 366/337
2002/0195067 A1 12/2002 Murakami et al.
2004/0035194 A1 2/2004 Wakahara
2007/0251582 A1 * 11/2007 Farkh ..... B60H 1/00485 137/455
2009/0308346 A1 * 12/2009 Vandike ..... F02M 35/02 123/198 E
2009/0320786 A1 12/2009 Fisher
2011/0135933 A1 * 6/2011 Shoko ..... B01F 3/0807 428/402.2
2015/0176470 A1 * 6/2015 Lee ..... F01P 7/14 123/41.29
2015/0354436 A1 * 12/2015 Park ..... F01P 7/14 123/41.08
2016/0053911 A1 * 2/2016 Klein ..... F16K 31/02 137/625.45
2017/0037777 A1 * 2/2017 Bellinger ..... F01P 3/20

FOREIGN PATENT DOCUMENTS

EP 2573353 A1 3/2013
EP 2674586 A1 12/2013
EP 2837788 A1 2/2015
JP H08-319831 A 12/1996
JP 2010-504455 A 2/2010
JP 2011-021482 A 2/2011
JP 2012-220142 A 11/2012
JP 2013-133986 A 7/2013

* cited by examiner

COOLING APPARATUS FOR INTERNAL COMBUSTION ENGINE

INCORPORATION BY REFERENCE

The disclosure of Japanese Patent Application No. 2015-031483 filed on Feb. 20, 2015 including the specification, drawings and abstract is incorporated herein by reference in its entirety.

BACKGROUND

1. Technical Field

The disclosure relates to a cooling apparatus for an internal combustion engine.

2. Description of Related Art

Japanese Patent Application Publication No. 2011-21482 describes a cooling apparatus for an automobile engine (internal combustion engine). In this cooling apparatus, a main circuit and a warm-up circuit are connected to the outlet side of a coolant jacket formed inside an engine body. The main circuit is provided with a radiator. The warm-up circuit allows a coolant flow to bypass the main circuit. This cooling apparatus includes a coolant pump and a thermostat. The coolant pump is operated in response to an operation of the engine. The thermostat is switched between a closed state where a coolant discharged from the coolant jacket is introduced into the warm-up circuit, and an open state where the coolant discharged from the coolant jacket is introduced into the main circuit, depending on the coolant temperature.

The thermostat is kept in the closed state during cold start of the engine. Thus, the coolant discharged from the coolant jacket is introduced into the warm-up circuit to bypass the radiator, so that the engine is promptly warmed up. Upon completion of warm-up of the engine, the thermostat is switched to the open state. Thus, the coolant discharged from the coolant jacket is introduced into the main circuit, and heat recovered from the engine body is released into the atmosphere by the radiator.

Some cooling apparatuses are provided with a coolant temperature sensor disposed at a position at the outlet side of the coolant jacket and upstream of the position at which the main circuit is connected to the coolant jacket, and control the engine (e.g., control the fuel injection amount) based on the coolant temperature detected by the coolant temperature sensor. After cold start of the engine, before the thermostat is switched to the open state, that is, before the thermostat makes switchover from the state where the coolant discharged from the coolant jacket flows through the warm-up circuit to the state where the coolant discharged from the coolant jacket flows through the main circuit, the engine stops and thus the coolant pump stops, and then the engine is restarted within a short period of time, in some cases.

SUMMARY

When circulation of the coolant through the circuit stops in response to the stop of the coolant pump, the outflow of the coolant from the coolant jacket also stops. At the same time, the pressure in the coolant jacket may decrease temporarily, resulting in a pressure difference between the inside of the coolant jacket and the inside of the main circuit. In this case, the coolant retained in the main circuit flows toward the inside of the coolant jacket, and this coolant flows into the vicinity of the coolant temperature sensor.

Specifically, during the engine warm-up operation, the coolant is not introduced into the main circuit and the coolant is retained in the main circuit. The coolant retained in the main circuit rises in temperature, for example, by being exposed to radiation heat from the engine. Then, in the main circuit, due to the difference in density between the coolant having a relatively high temperature and the coolant having a relatively low temperature, the coolant having a relatively high temperature is retained in an upper region of the internal space of a pipe (pipe extending in the substantially horizontal direction) and the coolant having a relatively low temperature is retained in a lower region of the internal space of the pipe. When the coolant inside the main circuit flows into the vicinity of the coolant temperature sensor in response to the stop of the coolant pump as described above, the coolant having a relatively low temperature retained in the lower region in the pipe may flow to the vicinity of the coolant temperature sensor.

If the engine is restarted in such a state, control for increasing the engine speed (so-called idle-up control) is executed at the initial stage of restart because the coolant temperature sensor detects the temperature of the coolant having a relatively low temperature. That is, although the actual coolant temperature has become relatively high due to the immediately preceding cold start operation (e.g., although the coolant temperature in the coolant jacket has become high enough that idle-up control is unnecessary), unnecessary idle-up control is executed due to the low coolant temperature detected by the coolant temperature sensor. Consequently, an excessive amount of fuel is injected, which may deteriorate the fuel consumption.

The disclosed embodiments provide a cooling apparatus for an internal combustion engine configured to prevent an excessive amount of fuel from being injected during restart of the engine.

A first aspect provides a cooling apparatus for an internal combustion engine, the cooling apparatus includes a main circuit, a warm-up circuit, a coolant passage, a coolant pump, a pre-branching passage, a coolant temperature sensor and an agitator. The main circuit is provided with a radiator. The warm-up circuit bypasses the main circuit and thus allows a coolant to bypass the main circuit. The coolant passage is provided inside a body of the internal combustion engine. The coolant pump is configured to cause the coolant to flow through the coolant passage. The pre-branching passage is communicated with an outlet side of the coolant passage, and communicated with the main circuit and the warm-up circuit. The coolant temperature sensor is configured to detect a coolant temperature inside the pre-branching passage. The agitator is disposed downstream of the coolant temperature sensor in a direction of coolant flow when the coolant pump is operating. The agitator is disposed at a boundary between the pre-branching passage and the main circuit or in a vicinity of the boundary. The agitator is configured to agitate the coolant while the coolant flows between the main circuit and the pre-branching passage.

During a warm-up operation of the internal combustion engine, the coolant discharged from the coolant passage of the internal combustion engine body bypasses the main circuit and flows through the warm-up circuit. In this period, the coolant is retained in the main circuit, and this coolant inside the main circuit rises in temperature, for example, by being exposed to radiation heat from the internal combustion engine. Then, inside the main circuit, due to the difference in density between the coolant having a relatively high temperature and the coolant having a relatively low temperature, the coolant having a relatively high temperature is retained in an upper region of the inside of a pipe and the coolant having a relatively low temperature is retained in a lower region of the pipe. In this situation, when the coolant pump stops in response to the stop of the internal combustion engine, a pressure difference occurs in the circuit. In this case, the coolant retained in the main circuit flows toward the pre-branching passage, and this coolant flows into the vicinity of the coolant temperature sensor, in some cases. In such a case, the coolant is agitated by the agitator disposed at the boundary between the pre-branching passage and the main circuit or in the vicinity of the boundary. As a result, the coolant having a relatively high temperature retained in the upper region inside the pipe and the coolant having a relatively low temperature retained in the lower region thereof are mixed together, so that the coolant having a relatively high temperature (coolant having a temperature higher than the temperature of the coolant retained in the lower region) is mixed with the relatively low temperature coolant and flows into the vicinity of the coolant temperature sensor. Consequently, it is possible to prevent an excessively large amount of fuel from being injected when the internal combustion engine is restarted, thereby preventing deterioration of the specific fuel consumption.

In the cooling apparatus, the agitator may be disposed inside the main circuit, and the agitator may be a wire mesh, the wire mesh extending in a direction perpendicular to an axis of a main circuit pipe that defines the main circuit.

Thus, the agitator can be provided so as to be integral with the pipe that defines the main circuit. This makes it possible to relatively easily achieve the configuration for providing the cooling apparatus with the agitator. Moreover, because the agitator is a wire mesh and thus has no moving portion, the configuration of the agitator can be simplified.

In the cooling apparatus, the agitator may be disposed only in a vertically lower-half region of a cross-section of the main circuit pipe perpendicular to the axis of the main circuit pipe extending in a horizontal direction.

With this configuration, the agitator is disposed in the lower region where the coolant having a relatively low temperature is retained, in the pipe that defines the main circuit. That is, when the coolant retained in the main circuit flows into the vicinity of the coolant temperature sensor, the coolant having a relatively high temperature retained in the upper region inside the pipe flows into the pre-branching passage with almost no pressure loss, whereas the coolant having a relatively low temperature retained in the lower region inside the pipe flows into the pre-branching passage with pressure loss caused by the agitator (wire mesh). Due to the difference in pressure loss, the coolant having a relatively high temperature retained in the upper region and the coolant having a relatively low temperature retained in the lower region are appropriately mixed together before flowing into the vicinity of the coolant temperature sensor.

A second aspect provides a cooling apparatus for an internal combustion engine, the internal combustion engine having a coolant passage. The cooling apparatus includes a main circuit pipe, a warm-up circuit pipe, a coolant splitting member, a coolant pump, a coolant temperature sensor and an agitator. The main circuit pipe is part of a main circuit. The main circuit pipe is communicated with a radiator. The warm-up circuit pipe is part of a warm-up circuit. The warm-up circuit pipe is configured to bypass the main circuit pipe. The coolant splitting member has a pre-branching passage. The pre-branching passage is configured to be connected to an outlet side of the coolant passage of the internal combustion engine, and the coolant splitting member is connected to the main circuit pipe and the warm-up circuit pipe. The coolant pump is configured to cause a coolant to flow through the coolant passage. The coolant temperature sensor disposed in the coolant splitting member. The coolant temperature sensor is configured to detect a coolant temperature inside the pre-branching passage. The agitator is disposed downstream of the coolant temperature sensor in a direction of coolant flow when the coolant pump is operating. The agitator is disposed at a boundary between the pre-branching passage and the main circuit or in a vicinity of the boundary. The agitator is configured to agitate the coolant while the coolant flows between the main circuit and the pre-branching passage.

In the above aspect, there is provided the agitator that agitates the coolant while the coolant flows between the main circuit and the pre-branching passage. Therefore, when the coolant retained in the main circuit flows into the vicinity of the coolant temperature sensor disposed inside the pre-branching passage, the coolant is agitated and the coolant having a relatively high temperature and the coolant having a relatively low temperature both retained in the main circuit are mixed together, so that the coolant having a relatively high temperature is mixed with the relatively low temperature coolant and flows into the vicinity of the coolant temperature sensor. Consequently, it is possible to prevent an excessively large amount of fuel from being injected when the internal combustion engine is restarted, thereby preventing deterioration of the specific fuel consumption.

BRIEF DESCRIPTION OF THE DRAWINGS

Features, advantages, and technical and industrial significance of exemplary embodiments will be described below with reference to the accompanying drawings, in which like numerals denote like elements, and wherein.

DETAILED DESCRIPTION OF EMBODIMENTS

Hereinafter, an example embodiment will be described with reference to the accompanying drawings. In the present embodiment, a cooling apparatus for an automobile engine will be described.

Figure 1:
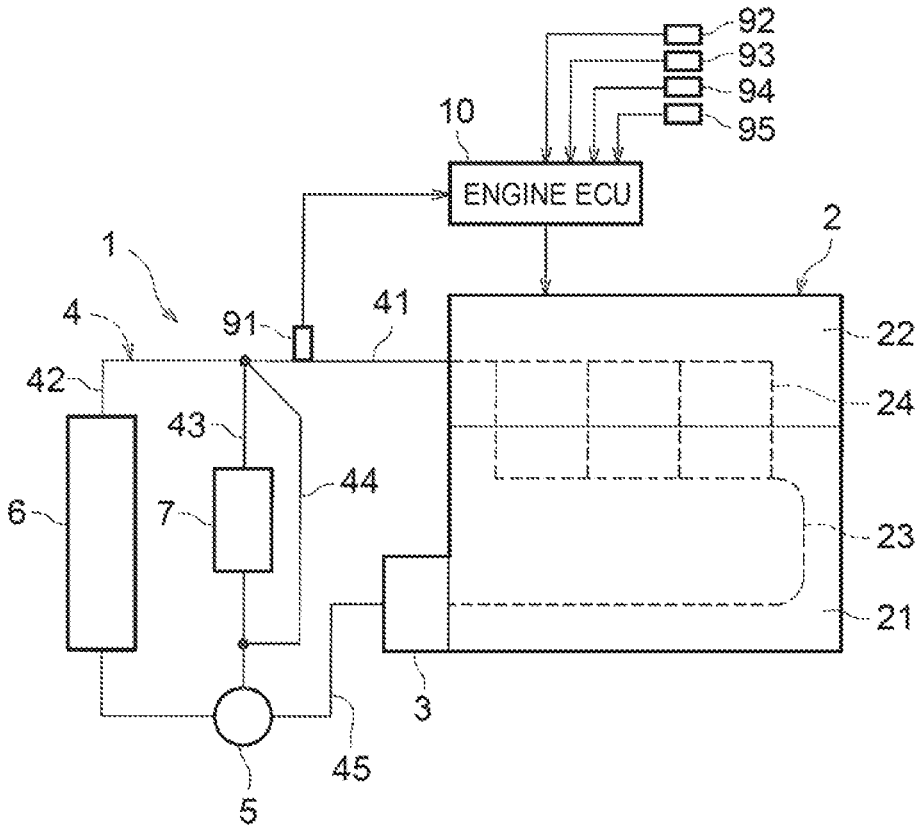
FIG. 1 is a view illustrating the schematic configuration of a cooling apparatus for an internal combustion engine in an embodiment.

FIG. 1 is a view illustrating the schematic configuration of a cooling apparatus 1 according to the present embodiment. An engine body 2 is a gasoline engine. The engine body 2 includes a cylinder block 21 and a cylinder head 22. The engine body 2 has coolant jackets 23, 24 (one example of a coolant passage) through which a coolant is circulated. Specifically, the coolant jacket 23 formed inside the cylinder block 21 and the coolant jacket 24 formed inside the cylinder head 22 communicate with each other.

A coolant pump 3 is connected to a crankshaft (not illustrated), which is an output shaft of the engine body 2, and the coolant pump 3 is operated by the turning force of the crankshaft. An outlet of this coolant pump 3 communicates with the coolant jacket 23 of the cylinder block 21. When the coolant pump 3 is operating, the coolant discharged from the coolant pump 3 is introduced into the coolant jacket 23 of the cylinder block 21. The coolant pump 3 may be an electrically-driven pump.

A coolant circuit 4 is connected to the engine body 2. The coolant circulates through the coolant circuit 4 in response to the operation of the coolant pump 3. This coolant circuit 4 includes a pre-branching passage 41, a main circuit 42, a warm-up circuit 43, a bypass circuit 44, and a return circuit 45.

The pre-branching passage 41 has one end communicated with the outlet side of the coolant jacket 24 of the cylinder head 22, and distributes the coolant discharged from the coolant jacket 24 to the main circuit 42, the warm-up circuit 43, and the bypass circuit 44.

Figure 2:
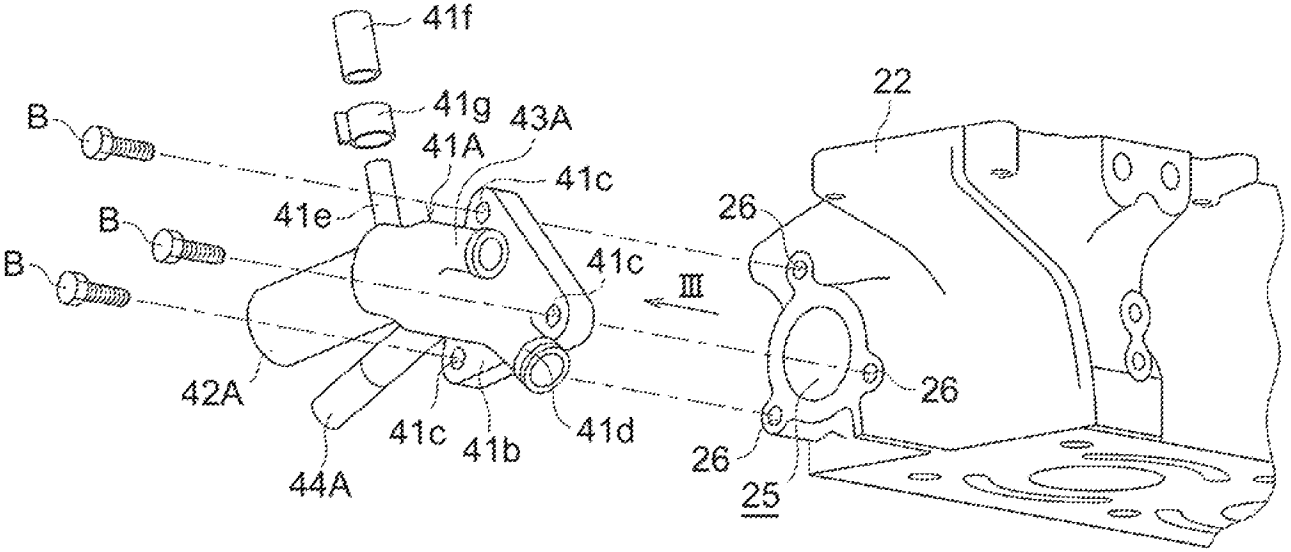
FIG. 2 is an exploded perspective view of a cylinder head and a coolant splitting member.
Figure 3:
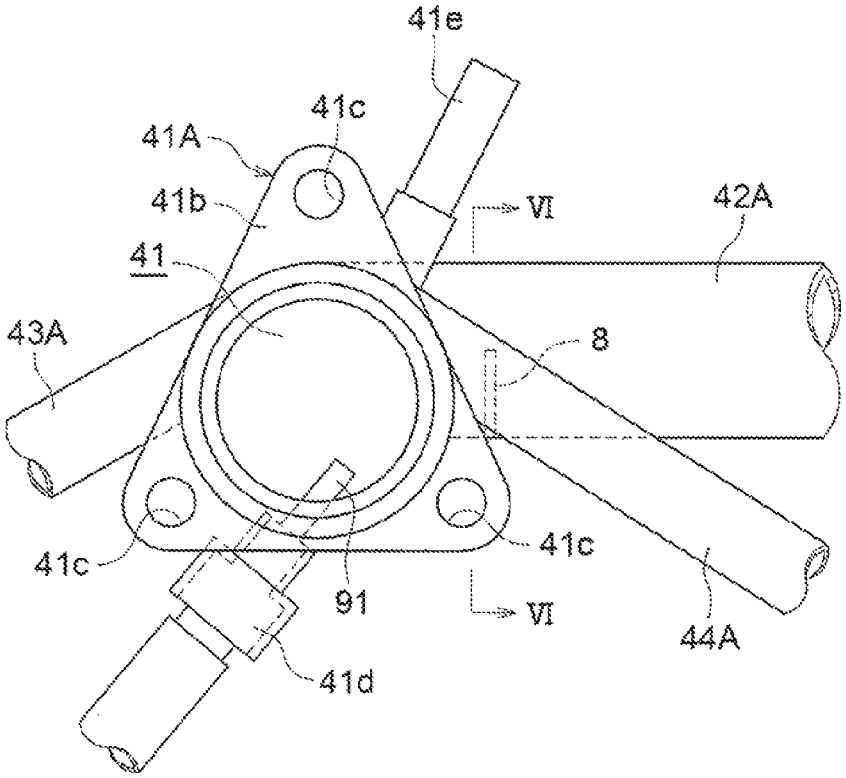
FIG. 3 is a view of the coolant splitting member as viewed from the direction of an arrow II in FIG. 2.

Specifically, a coolant splitting member 41A is connected to the opening edge of a coolant outlet 25, which is the downstream end of the coolant jacket 24 of the cylinder head 22, as illustrated in FIG. 2 (exploded perspective view of the cylinder head 22 and the coolant splitting member 41A) and FIG. 3 (view of the coolant splitting member 41A as viewed from the direction of an arrow III in FIG. 2). The coolant splitting member 41A is a cylindrical member one end of which is open. The coolant splitting member 41A has a flange 41*b* at its open-side end. The flange 41*b* has a plurality of bolt through-holes 41*c* that correspond to bolt holes 26 formed in the opening edge of the coolant outlet 25. The coolant splitting member 41A is fitted to the cylinder head 22 by aligning the bolt through-holes 41*c* with the bolt holes 26, inserting bolts B into the holes 41*c*, 26, and screwing the bolts B into the bolt holes 26. Thus, the coolant discharged from the coolant outlet 25 of the coolant jacket 24 flows into the pre-branching passage 41 formed of the internal space of the coolant splitting member 41A.

The coolant splitting member 41A is connected to a main circuit pipe 42A that defines the main circuit 42, a warm-up circuit pipe 43A that defines the warm-up circuit 43, and a bypass circuit pipe 44A that defines the bypass circuit 44.

As illustrated in FIG. 1, one end of the main circuit 42 defined by the main circuit pipe 42A is connected to the pre-branching passage 41 (internal space of the coolant splitting member 41A), while the other end thereof is connected to a first inlet of a thermostat 5. The main circuit 42 is provided with a radiator 6. That is, the main circuit pipe 42A communicates with the radiator 6.

The warm-up circuit 43 defined by the warm-up circuit pipe 43A allows a coolant flow to bypass the main circuit 42. One end of the warm-up circuit 43 is connected to the pre-branching passage 41, while the other end thereof is connected to a second inlet of the thermostat 5. This warm-up circuit 43 is provided with a heater core 7.

One end of the bypass circuit 44 defined by the bypass circuit pipe 44A is connected to the pre-branching passage 41, while the other end thereof is connected to the warm-up circuit 43 at a position downstream of the heater core 7 (at a position between the heater core 7 and the thermostat 5). The inner diameter of the bypass circuit pipe 44A that defines the bypass circuit 44 is smaller by a prescribed amount than the inner diameter of the warm-up circuit pipe 43A that defines the warm-up circuit 43. During warm-up operation in which the coolant is circulated while bypassing the main circuit 42, the amount of coolant flowing through the warm-up circuit 43 is reduced by an amount of coolant flowing through the bypass circuit 44. In this way, the amount of coolant flowing through the warm-up circuit 43 is limited.

One end of the return circuit 45 is connected at an outlet of the thermostat 5, while the other end thereof is connected to an inlet of the coolant pump 3.

The thermostat 5 is a valve device that is operated through expansion and contraction of thermowax (temperature sensing portion). When the temperature of coolant flowing into the thermostat 5 is low (when the temperature is lower than the engine warm-up completion temperature), the thermostat 5 is placed in the valve-closed state (closes the first inlet and opens the second inlet) to block the communication between the main circuit 42 and the return circuit 45 and to provide communication between the warm-up circuit 43 and the return circuit 45. When the temperature of the coolant flowing into the thermostat 5 is high (when the temperature is equal to or higher than the engine warm-up completion temperature), the thermostat 5 is placed in the valve-open state (opens the first inlet and closes the second inlet) to block the communication between the warm-up circuit 43 and the return circuit 45 and to provide communication between the main circuit 42 and the return circuit 45.

The radiator 6 is, for example, a downflow radiator, and is configured to carry out heat exchange between coolant flowing down inside the radiator 6 and external air, thereby releasing the heat of the coolant into the external air.

The heater core 7 is provided to heat the vehicle cabin by utilizing the heat of the coolant, and is disposed to face a fan duct of an air conditioner. That is, during heating of the vehicle cabin (while a heater is on), the air for air-conditioning flowing inside the air blow duct is turned into warm air by passing through the heater core 7 and the warm air is supplied to the vehicle cabin.

As illustrated in FIG. 2 and FIG. 3, the coolant splitting member 41A is provided with a coolant temperature sensor mounting pipe 41*d*, and a coolant temperature sensor 91 (see FIG. 3) is inserted into the coolant temperature sensor mounting pipe 41*d*. Thus, the coolant temperature inside the coolant splitting member 41A (pre-branching passage 41) can be detected by the coolant temperature sensor 91.

The coolant splitting member 41A is connected to an air-bleeding pipe 41*e* through which the air remaining inside the coolant circuit 4 is expelled when the coolant inside the circuit is replaced. The air-bleeding pipe 41*e* is closed with a cap 41*f* and a fastener 41*g* at times other than replacement of the coolant.

With the configuration described above, the coolant jackets 23, 24, the coolant circuit 4, and the coolant temperature sensor 91 constitute the cooling apparatus 1.

The engine body 2 is provided with an engine ECU 10 as an electronic control unit that controls operation of the engine body 2. The engine ECU 10 is a unit that controls the operation state of the engine body 2 based on the operating conditions of the engine body 2 and requests issued by a driver. The engine ECU 10 is connected, through electrical wiring, not only to the coolant temperature sensor 91, but also to, for example, an accelerator operation degree sensor 92 that outputs a signal indicating the accelerator operation degree, i.e., the engine load, a crank position sensor 93 that outputs a signal indicating the rotational speed of the crankshaft, an air flowmeter 94 that outputs a signal indicating the amount of air taken into the engine body 2, and an external air temperature sensor 95 that outputs a signal indicating the temperature of external air. The output signals from the sensors 91 to 95 are input into the engine ECU 10.

Idle-up control is one of the controls of the engine body 2 executed by the engine ECU 10. Idle-up control is executed to control the engine speed during the idling operation of the engine body 2, and executed to increase the engine speed when the coolant temperature (coolant temperature inside the pre-branching passage 41) detected by the coolant temperature sensor 91 is lower than a prescribed temperature, or when auxiliaries for the engine body 2 are operated. Specifically, the idle-up control is executed to increase the engine speed by increasing the amount of fuel injected from the injectors provided in the engine body 2.

Figure 4:
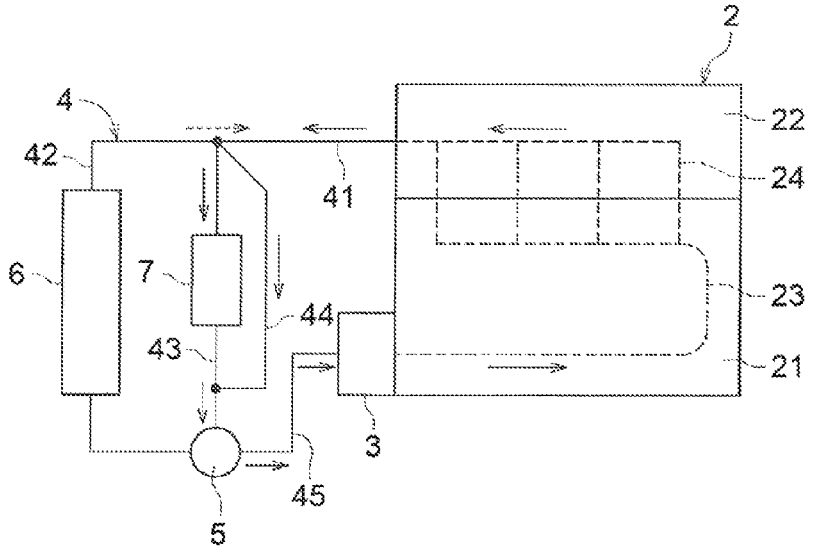
FIG. 4 is a view, corresponding to FIG. 1, illustrating the flow of coolant during an engine warm-up operation.
Figure 5:
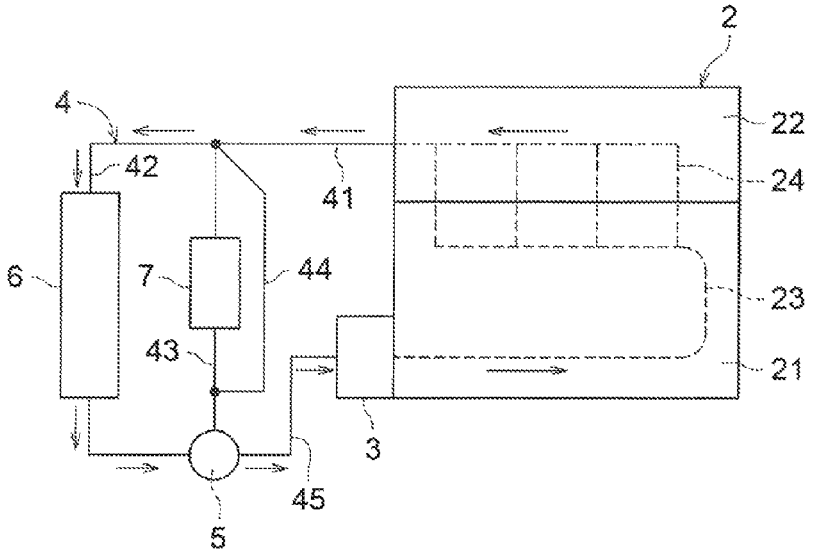
FIG. 5 is a view, corresponding to FIG. 1, illustrating the flow of coolant after completion of warm-up of an engine.

Next, the circulation manner of the coolant in the cooling apparatus 1 will be described with reference to FIG. 4 and FIG. 5.

During Warm-Up Operation

During the warm-up operation after cold start, the coolant temperature is low, so that the thermostat 5 is in the valve-closed state. When the coolant pump 3 is actuated in response to starting of the engine, the coolant is circulated sequentially through the coolant pump 3, the coolant jackets 23, 24, the pre-branching passage 41, the warm-up circuit 43, the return circuit 45, and the coolant pump 3, as indicated by solid arrows in FIG. 4. Part of the coolant passed through the pre-branching passage 41 bypasses the heater core 7 and flows through the bypass circuit 44.

In this way, the circulating coolant bypasses the radiator 6 and thus the coolant is not cooled in the radiator 6. As a result, warm-up of the engine is completed promptly.

After Completion of Warm-Up

As the warm-up operation continues and the coolant temperature rises, the thermostat 5 is switched to the valve-open state. In this case, as indicated by arrows in FIG. 5, the coolant is circulated sequentially through the coolant pump 3, the coolant jackets 23, 24, the pre-branching passage 41, the main circuit 42, the return circuit 45, and the coolant pump 3.

Thus, the heat recovered from the engine body 2 is released into the atmosphere by the radiator 6.

Figure 6:
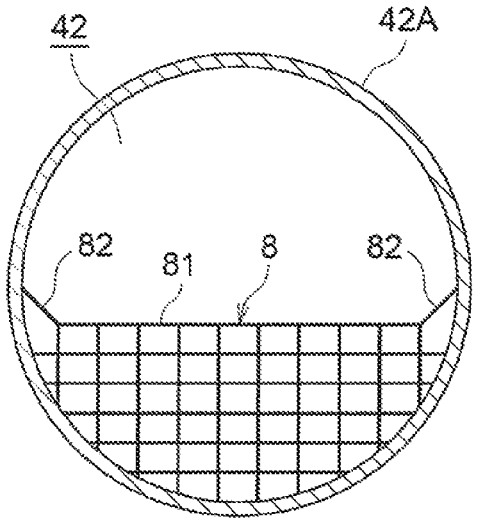
FIG. 6 is a cross-sectional view taken along the line VI-VI in FIG. 3.

The feature of the present embodiment is that an agitator 8 is provided inside the main circuit 42. The agitator 8 will be described below. As illustrated in FIG. 3 and FIG. 6 (cross-sectional view taken along the line VI-VI in FIG. 3), the agitator 8 formed of a wire mesh is disposed at a position inside the main circuit pipe 42A that defines the main circuit 42 and in the vicinity of the junction at which the main circuit pipe 42A is connected to the coolant splitting member 41A that defines the pre-branching passage 41. That is, the agitator 8 is disposed at a position downstream of the coolant temperature sensor 91 in the coolant flow direction when the coolant pump 3 is operating and in the vicinity of the boundary between the pre-branching passage 41 and the main circuit 42.

Specifically, the agitator 8 is disposed inside the main circuit pipe 42A at a position (in the vicinity of the boundary) about several millimeters away from the upstream end position of the main circuit 42 (the boundary with the pre-branching passage 41). Inside the main circuit pipe 42A, the agitator 8 is disposed in the region of an approximately lower-half part of a cross-section of the main circuit pipe 42A, which is perpendicular to the axis thereof (more specifically, the region that covers 40% of this cross-section). The agitator 8 is formed of metal wires having a wire diameter of, for example, 1 mm, which are arranged to form a 5 mm mesh. The edges of each wire are fixed to the inner surface of the main circuit pipe 42A, for example, by welding. Note that these values are not limited to the aforementioned values, but may be set as needed. End portions of a wire 81 located uppermost among the wires extending horizontally are used as tilted wires 82, 82 that are tilted upward in a direction toward the inner surface of the main circuit pipe 42A.

Because the agitator 8 is thus disposed inside the main circuit pipe 42A, when the coolant flows through the main circuit pipe 42A, almost no pressure loss occurs in the coolant flowing through the upper region inside the main circuit pipe 42A. In contrast to this, pressure loss due to the agitator 8 occurs in the coolant flowing through the lower region inside the main circuit pipe 42A.

Next, description will be provided on the operation of the cooling apparatus during the engine restart period when the advantageous effect of the agitator 8 is obtained.

During the engine warm-up operation described with reference to FIG. 4, the coolant discharged from the coolant outlet 25 (see FIG. 2) of the coolant jacket 24 bypasses the main circuit 42 and flows through the warm-up circuit 43 and the bypass circuit 44. In this period, the coolant is retained in the main circuit 42, and this coolant inside the main circuit 42 rises in temperature, for example, by being exposed to radiation heat from the engine body 2. Then, inside the main circuit 42, due to the difference in density between the coolant having a relatively high temperature and the coolant having a relatively low temperature, the coolant having a relatively high temperature is retained in the upper region of the inside of the main circuit pipe 42A and the coolant having a relatively low temperature is retained in the lower region thereof. In this situation, when the coolant pump 3 stops in response to the stop of the engine body 2, the pressure in the coolant jacket 24 may decrease temporarily, resulting in a pressure difference between the inside of the coolant jacket 24 and the inside of the main circuit 42. In this case, the coolant retained in the main circuit 42 flows toward the inside of the coolant jacket 24 (see a dashed arrow in FIG. 4), and this coolant flows into the vicinity of the coolant temperature sensor 91.

In such a case, the coolant is agitated by the agitator 8. As a result, the coolant having a relatively high temperature retained in the upper region inside the main circuit pipe 42A and the coolant having a relatively low temperature retained in the lower region are mixed together, so that the coolant having a relatively high temperature (coolant having a temperature higher than the temperature of the coolant retained in the lower region) flows into the vicinity of the coolant temperature sensor 91.

Figure 7:
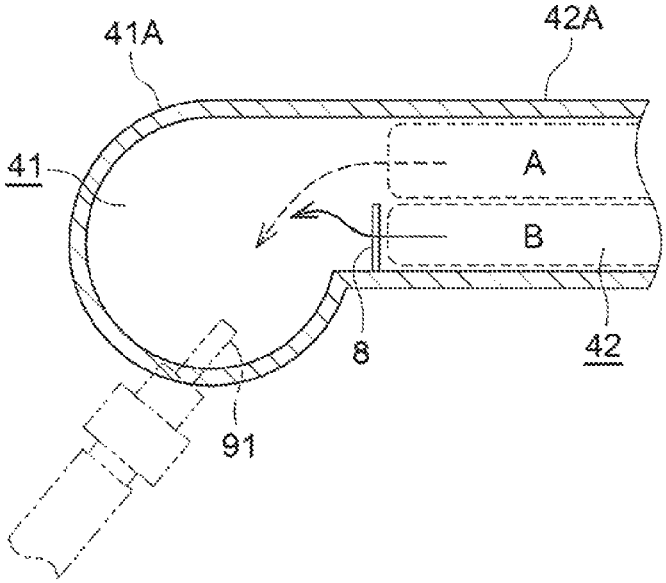
FIG. 7 is a sectional view of a main circuit pipe and the coolant splitting member, illustrating the flow of coolant while a coolant pump is at a standstill.

Specifically, as illustrated in FIG. 7 (sectional view of the main circuit pipe 42A and the coolant splitting member 41A, for illustrating a flow of the coolant while the coolant pump 3 is at a standstill), when the coolant retained in the main circuit pipe 42A (main circuit 42) flows into the vicinity of the coolant temperature sensor 91, the coolant having a relatively high temperature retained in the upper region inside the main circuit pipe 42A (coolant retained in a region defined by a dashed line and indicated by a reference character A in FIG. 7) flows into the coolant splitting member 41A (pre-branching passage 41) with almost no pressure loss (see the dashed arrow in FIG. 7). In contrast to this, the coolant having a relatively low temperature retained in the lower region inside the main circuit pipe 42A (coolant retained in a region defined by a dashed line and indicated by a reference character B in FIG. 7) flows into the coolant splitting member 41A with pressure loss caused by the agitator 8 (see a solid arrow in FIG. 7). The difference in pressure loss causes a difference in flow velocity between the coolant having a relatively high temperature and flowing into the coolant splitting member 41A and the coolant having a relatively low temperature and flowing into the coolant splitting member 41A, so that the coolant having a relatively low temperature is caught in the flow of the coolant having a relatively high temperature. In this way, the coolant having a relatively high temperature and the coolant having a relatively low temperature are mixed together. That is, the coolant having a relatively high temperature retained in the upper region and the coolant having a relatively low temperature retained in the lower region are appropriately mixed together before flowing into the vicinity of the coolant temperature sensor 91. As a result, the coolant having a relatively high temperature (coolant having a temperature higher than the temperature of the coolant retained in the lower region) flows into the vicinity of the coolant temperature sensor 91.

Thus, it is possible to avoid the situation where, when the engine is restarted later, although the coolant temperature has become relatively high due to the immediately preceding cold start operation (e.g., although the coolant temperature inside the coolant jackets 23, 24 has become high enough that idle-up control is not necessary), unnecessary idle-up control is executed due to the low coolant temperature detected by the coolant temperature sensor 91. Consequently, it is possible to prevent the fuel injection amount from becoming excessively large, thereby preventing deterioration of the fuel consumption. Further, smoldering of ignition plugs is avoided.

The agitator 8 achieves its function of agitating the coolant when the coolant flows from the pre-branching passage 41 into the main circuit pipe 42A even during normal operation after completion of warm-up. Therefore, even when the coolant discharged from the coolant outlet 25 of the coolant jacket 24 and then introduced into the pre-branching passage 41 has a relatively high-temperature region and a relatively low-temperature region, the temperature of the entirety of the coolant flowing through the main circuit pipe 42A is made uniform through agitation of the coolant by the agitator 8. As a result, heat exchange between the coolant and the external air is carried out uniformly by the entirety of the radiator 6, which allows high-efficiency heat exchange.

In the foregoing embodiment, the agitator 8 is formed of the wire mesh that is disposed inside the main circuit pipe 42A at a position about several millimeters away from the upstream end position of the main circuit 42. However, the position of the agitator 8 is not limited to the above-described position. The agitator 8 may be disposed at the upstream end position of the main circuit 42 (the boundary between the main circuit 42 and the pre-branching passage 41; the boundary portion), or disposed inside the pre-branching passage 41, as long as the agitator 8 is disposed upstream of the coolant temperature sensor 91 when the coolant flows from the main circuit 42 toward the pre-branching passage 41.

In the foregoing embodiment, the agitator 8 is formed of a wire mesh composed of wires extending vertically and wires extending horizontally. However, the agitator 8 may be formed only of wires extending vertically or may be formed only of wires extending horizontally, as long as the agitator 8 has the function of agitating the coolant while the coolant is circulating between the main circuit 42 and the pre-branching passage 41.

In the foregoing embodiment, the engine body 2 is a gasoline engine. However, the engine body 2 is not limited to a gasoline engine, and the engine body 2 may be other kinds of engines, such as a diesel engine.

The disclosed embodiments and modifications of the disclosed embodiments are applicable to a cooling apparatus for an automobile internal combustion engine, which controls the fuel injection amount based on the coolant temperature at the outlet side of a coolant jacket.

What is claimed is:

1. A cooling apparatus for an internal combustion engine, the cooling apparatus comprising:

a main circuit provided with a radiator;

a warm-up circuit that bypasses the main circuit to allow a coolant to bypass the main circuit;

a coolant passage provided inside a body of the internal combustion engine;

a coolant pump configured to cause the coolant to flow through the coolant passage;

a pre-branching passage communicated with an outlet side of the coolant passage, and communicated with the main circuit and the warm-up circuit;

a coolant temperature sensor configured to detect a coolant temperature inside the pre-branching passage; and an agitator disposed downstream of the coolant temperature sensor in a direction of coolant flow when the coolant pump is operating, the agitator being disposed at a boundary between the pre-branching passage and the main circuit or in a vicinity of the boundary, the agitator being configured to agitate the coolant while the coolant flows between the main circuit and the pre-branching passage, wherein the main circuit includes a main circuit pipe that defines the main circuit, the main circuit pipe having an axis extending in a horizontal direction, and the agitator is disposed only in a vertically lower-half region of a cross-section of the main circuit pipe perpendicular to the axis of the main circuit pipe.

2. The cooling apparatus according to claim 1, wherein:

the agitator is a wire mesh, the wire mesh extending in a direction perpendicular to the axis of a main circuit pipe.

3. A cooling apparatus for an internal combustion engine, the internal combustion engine having a coolant passage, the cooling apparatus comprising:

a main circuit pipe that is part of a main circuit, the main circuit pipe being communicated with a radiator, the main circuit pipe having an axis extending in a horizontal direction;

a warm-up circuit pipe that is part of a warm-up circuit, the warm-up circuit pipe being configured to bypass the main circuit pipe;

a coolant splitting member having a pre-branching passage that is configured to be connected to an outlet side of the coolant passage of the internal combustion engine, the coolant splitting member being connected to the main circuit pipe and the warm-up circuit pipe;

a coolant pump configured to cause a coolant to flow through the coolant passage;

a coolant temperature sensor disposed in the coolant splitting member, the coolant temperature sensor being configured to detect a coolant temperature inside the pre-branching passage; and an agitator disposed downstream of the coolant temperature sensor in a direction of coolant flow when the coolant pump is operating, the agitator being disposed at a boundary between the pre-branching passage and the main circuit or in a vicinity of the boundary, the agitator being configured to agitate the coolant while the coolant flows between the main circuit and the pre-branching passage, wherein the agitator is disposed only in a vertically lower-half region of a cross-section of the main circuit pipe perpendicular to the axis of the main circuit pipe.

4. The cooling apparatus according to claim 3, wherein: the agitator is a wire mesh disposed inside the main circuit pipe, the wire mesh extending in a direction perpendicular to the axis of the main circuit pipe.

* * * * *